United States Patent [19]

Keehner et al.

[11] 4,351,234

[45] Sep. 28, 1982

[54] MARKING APPARATUS WITH ORBITING MARKING HEAD

[75] Inventors: James E. Keehner, Salem; Samuel A. Linn, Silverton; Marvin L. Kahut, Woodburn; Bobby G. Forrester, Silverton; Roy E. Bohanan, Salem, all of Oreg.

[73] Assignee: General Foods Corporation, White Plains, N.Y.

[21] Appl. No.: 166,003

[22] Filed: Jul. 7, 1980

[51] Int. Cl.[3] ..... B41F 17/24

[52] U.S. Cl. ..... 101/10; 101/27; 101/35; 101/44

[58] Field of Search ..... 101/41-44, 101/35, 27, 9-11

[56] References Cited

U.S. PATENT DOCUMENTS

| | | | |
|---|---|---|---|
| 1,694,955 | 12/1928 | Van Veen | 101/8 |
| 2,586,905 | 2/1952 | Bates | 41/1 |
| 2,736,257 | 2/1956 | Stephenson | 101/8 |
| 3,018,720 | 1/1962 | Nichols | 101/41 |
| 3,025,786 | 3/1962 | Johnson et al. | 101/44 |
| 3,118,370 | 1/1964 | Johnson et al. | 101/4 |
| 3,356,019 | 12/1967 | Zurick | 101/39 |
| 3,636,866 | 1/1972 | Stommel et al. | 101/22 |
| 3,730,081 | 5/1973 | Colledge | 101/25 |
| 3,815,494 | 6/1974 | Bahnmuller | 101/27 X |
| 3,851,579 | 12/1974 | Zurick | 101/39 |
| 3,922,964 | 12/1975 | Fisher | 101/9 |
| 4,048,913 | 9/1977 | Navi | 101/27 |

*Primary Examiner*—Clifford D. Crowder

*Attorney, Agent, or Firm*—Thomas R. Savoie; Daniel J. Donovan

[57] ABSTRACT

A principal object of the invention is to provide an improved marking apparatus capable of clearly marking desired information at the same relative location on a succession of rapidly-moving, heat-sensitive articles. Prior art marking devices employing heated printing heads presented problems when employed to mark in this manner. These problems became accute where the printing extended over any significant distance in the direction of travel.

The apparatus, shown generally as 10 in FIG. 1 is of the type comprising an electrically-heated marking head 12, a backup means 14 positioned opposite the marking head, and means 16 for reciprocating the marking head between a withdrawn position and a marking position adjacent to said backup means. A specific improvement according to the invention is the imparting elliptical motion of the printing head which enables contact times sufficient for clear marking at linear rates of greater than 1500 inches per minute.

4 Claims, 5 Drawing Figures

FIG. 1.
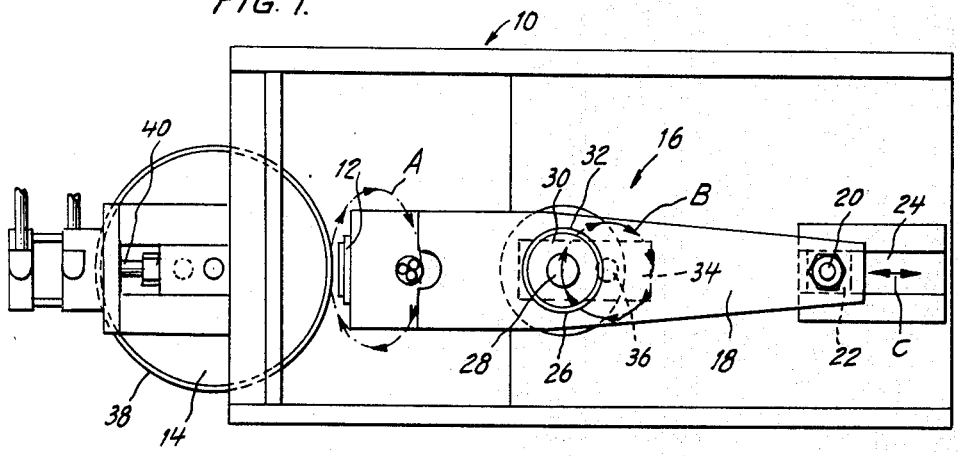
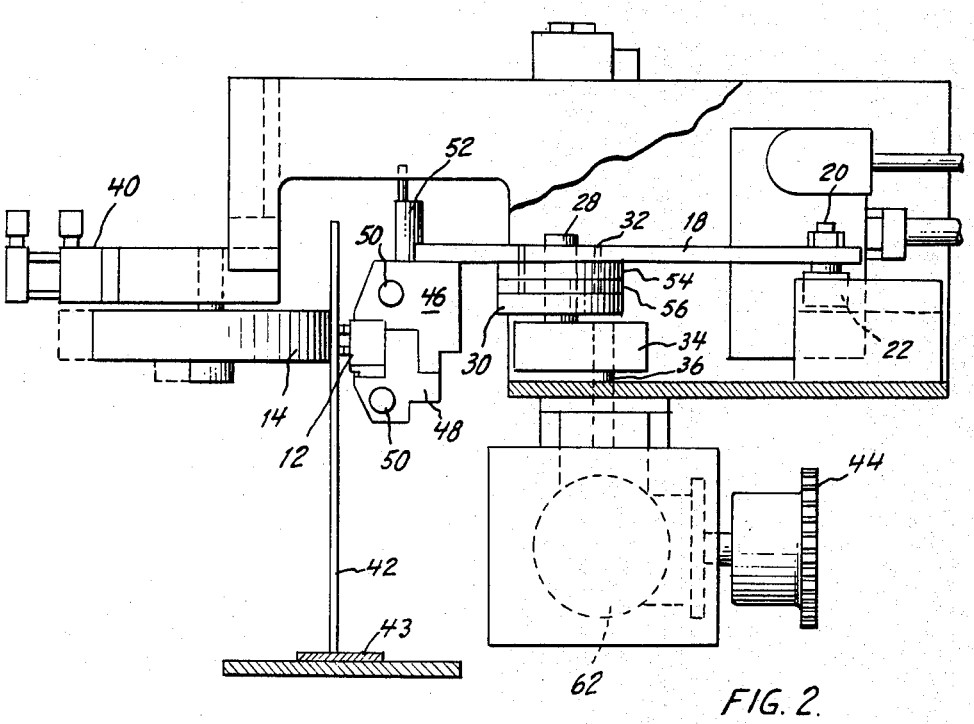
FIG. 2.

FIG. 3
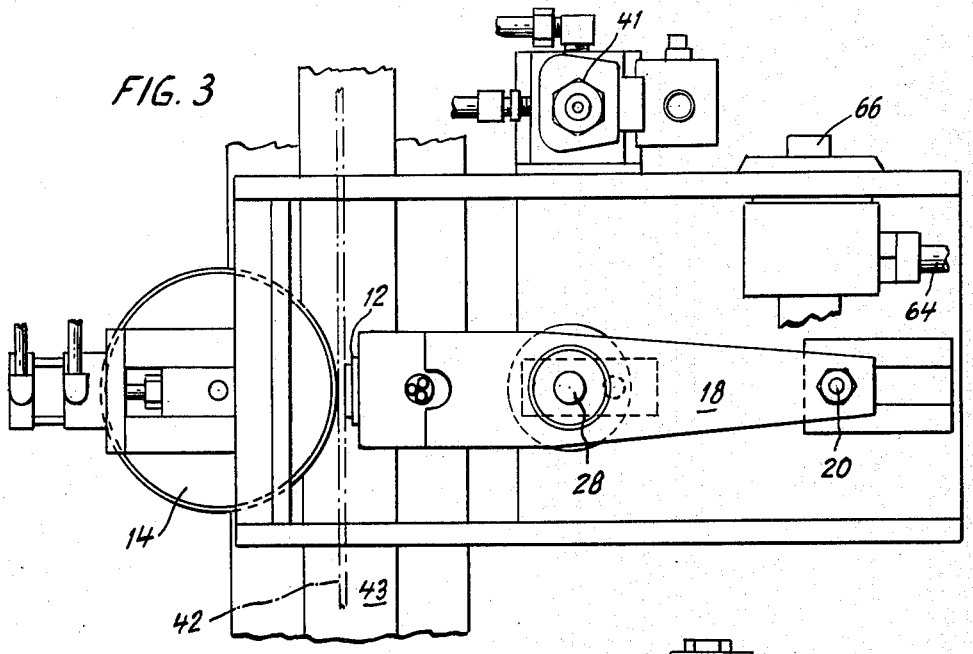
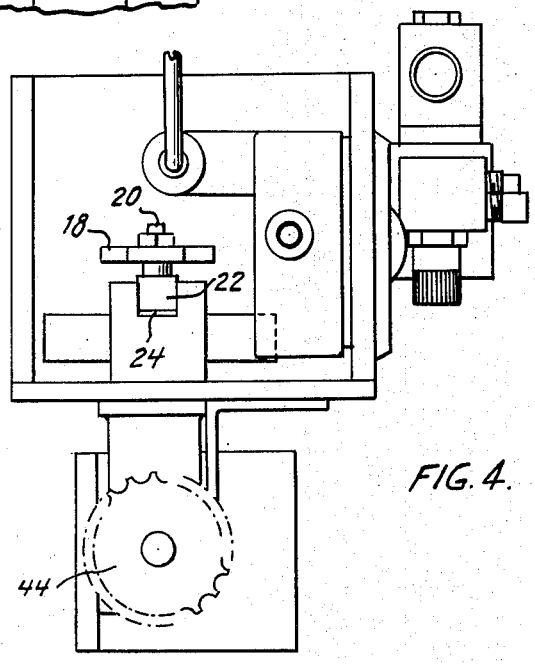
FIG. 4.

MARKING APPARATUS WITH ORBITING MARKING HEAD

DESCRIPTION

1. Technical Field

The present invention relates to a marking apparatus, and particularly to an improved apparatus for marking a succession of heat-sensitive articles moving at high speed past a heated marking head.

It is desirable to mark a variety of articles for many reasons. Packaged food products, for example, must contain certain information on the outer package. In addition to the ingredients and like information which can be imprinted at the time the carton blanks are printed, there is other information such as freshness dating and plant location which can be marked only at the time of packaging. Because of the high packaging line speeds normally employed, and the economic need to avoid a separate printing operation, it would be desirable to have an apparatus which could be interposed at some point in the packaging procedure to mark the packages as packaging progressed and be able to print a desired number of lines and characters.

2. Background Art

The prior art has suggested a number of marking devices for imprinting moving articles; however, no device is known which is capable of providing clearly legible markings at high speed by simply contacting a heat-sensitive article with a heated marking head.

Printing devices employing ink are known, such as those disclosed in U.S. Pat. No. 3,018,720 to Nichols and U.S. Pat. No. 2,586,905 to Bates; however, the ink and the mechanisms necessary to supply it add complication and expense to these devices. While the Nichols device provides for travel of the printing head with the direction of article movement, it does this by frictional engagement of the article with the print head and does not provide for positive registry and print head control.

In U.S. Pat. No. 3,636,866, Stommel et al also show a marking head which moves with a workpiece due to frictional contact. Again, positive registry and control are absent. The Stommel et al device marks by impression without the use of ink, and visibility is a problem due to poor contrast between printed and background areas.

While marking devices relying on impressions alone or ink do have advantages in certain operations, currently available devices of this type do not provide highly visible markings at reasonable cost. When marking paperboard, for example, impression-type markings are not easily readable and many inks are susceptible to smearing. Moreover, the ink printers are very expensive. The prior art has provided devices which imprint heat-sensitive articles with heated dies; however, these devices typically contact the articles at 90 degrees to the direction of flow and require contact times which restrict their use on high speed packaging equipment. U.S. Pat. No. 3,025,786 and U.S. Pat. No. 3,118,370 to Johnson et al are representative of marking devices of this type. Both devices employ a reciprocal, straight-line marking head movement which cannot print clearly at high speed on continuously moving articles. A rotary marking device is shown in U.S. Pat. No. 1,694,955 to Van Veen et al which is disclosed as providing good marking contact; however, the marking head requires a plurality of markers around its circumference and contact is tangential to the circular surface only. The need for multiple markers increases initial cost and complicates changing the information to be marked. The tangential contact to the circular path limits contact time and line speed. Further, many of the commercially-available marking devices are limited in the number of lines (e.g., one or two) and characters which can be printed in a single marking.

DISCLOSURE OF INVENTION

The present invention provides an improved marking apparatus for printing a desired number of lines and characters of the type comprising an electrically-heated marking head, backup means positioned opposite the marking head, and means for reciprocating the marking head between a withdrawn position and a marking position adjacent to said backup means, wherein the improvement in its broad aspects comprises: the means for reciprocating the marking head also move the marking head in a direction transverse to a line between the withdrawn and marking positions and effect an overall elliptical movement of the marking head in the direction of article flow, thereby permitting accurate marking and contact with the articles in the direction of flow of the articles moving continuously at high speeds past the marking head. Other improvements also appear in the more detailed features of the apparatus described and shown.

BRIEF DESCRIPTION OF DRAWINGS

The invention in both its broad and detailed aspects will become more apparent from the following description of the best mode for carrying out the invention, especially when read in light of the attached drawings wherein:

FIG. 1 is a simplified top plan view showing one embodiment of the principal components of the apparatus of the invention and their interrelation to provide elliptical motion to the marking head;

FIG. 2 is a side elevation, partially cut away, of a preferred form of marking device according to the invention;

FIG. 3 is a top plan view similar to FIG. 1, but in greater detail;

FIG. 4 is a real elevation of a preferred form of marking device according to the invention.

BEST MODE FOR CARRYING OUT THE INVENTION

Figure 5:
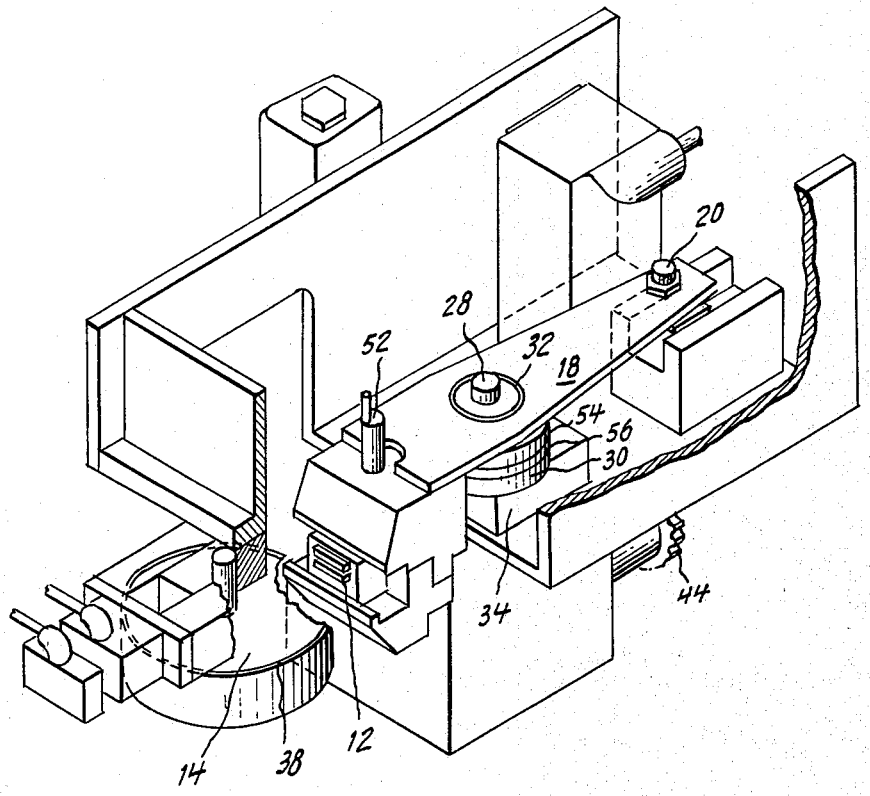
FIG. 5 is a perspective view of the apparatus shown in FIGS. 2–4.

The device shown in FIGS. 1–5 is particularly useful for imparting date and plant location codes on food containers made from paperboard, but will obviously have utility where any similar need for marking arises. When heat sensitive materials such as paperboard are to be marked with heat, the marking head must be heated sufficiently to mark the material but not so great as to damage the material. In addition to marking head temperature, the duration of contact with the material is also important. The apparatus of the present invention, shown generally as 10 in FIG. 1, is particularly advantageous because it moves the marking head 12 in an elliptical pattern enabling adequate contact with the articles during movement and in the direction of flow of the articles for clear and precise marking, and does not contact the articles at 90 degrees to the direction of article flow as is common with known marking devices.

FIG. 1 is a simplified top plan view showing one embodiment of the principal components of the apparatus of the invention and their interrelation to impart an elliptical motion to the heated marking head 12. The elliptical pattern of motion, shown by the path of arrows A, is the result of reciprocal motions shown by arrows B and C imparted to the marking head by means shown generally as 16. The marking head 12 is reciprocated in the direction of arrows C by means 16 between a withdrawn position, indicated by the extreme right hand side of elliptical path A (away from the backup means 14), and a marking position adjacent backup means 14, indicated by the extreme left hand side of elliptical path A. Movement is also imparted, as indicated by arrows B, in a circular motion, with drive shaft 36 being the center of the circular path.

The means 16 for imparting reciprocal movement to the marking head 12, comprise orbiting arm 18, here shown pivotally connected at 20 to slide 22 which moves within slide channel 24 (motion shown by arrow C). The orbiting arm 18 has an aperture 26 adapted to receive shaft 28, preferably with associated bearings 30 and 32, which provides rotary motion (shown by arrow B) and imparts the various motions A, B and C shown in the drawing. The elliptical pattern A results in prolonged contact time of the marking head 12 with an article to be marked during movement of the article and in the direction of flow of the article. The article is continuously passed by the marking head 12 along a straight line path contacting path A in the same direction of movement as the head 12 in the area of contact. The shaft 28 is shown in the preferred mode to be eccentrically attached to eccentric arm 34 which is constantly rotated by drive shaft 36.

The marking surface of marking head 12 preferably is flat, with the head moving in an eliptical pattern and in the same curvature as the backup means 14 when it is adjacent to the backup means 14 and in contact with the article 42. The backup means 14 is shown as a wheel having a resilient rubber surface 38. Means 40, preferably pneumatic as shown in the drawings, are preferably provided to withdraw the backup means 14 in response to any interruption in the continuous movement of the articles past the marking head.

In FIGS. 2 and 3, there is shown an article to be marked 42 being continuously conveyed, such as by conveyor 43, between marking head 12 and backup means 14. Should the continuous motion of article 42 be interrupted, sensors (not shown) would preferably sense this and cause pneumatic means 40 to receive control fluid from means 41 and withdraw backup means 14 to the position shown by the phantom lines. This reduces the possibility that articles to be marked will be damaged due to overheating during stoppages. A time delay may also be employed to compensate for the stoppage of the motion of the articles 42.

In a typical operation, the articles 42 will be conveyed by a means driven by, or adapted to be linked to, a chain drive means (not shown). FIGS. 2, 4 and 5 show sprocket means 44 for picking up drive power from such chain drive means. Where there are several different sizes of articles (e.g., cartons) to be marked, or where there are small interval differences (e.g., less than 2 to 3 inches) between articles to be marked, then the marking apparatus can be positioned to accommodate the differences. Where the interval difference between articles is greater it may be desirable to employ some adjustable syncronizing means, such as a Norwood Speed Synchronizer. Alternatively, the elliptical pattern of motion shown by arrows A can be adapted to correspond with the interval or spacing between the marking of the articles by adjusting the motion shown by arrows B and C (altering the orbiting arm 18 movement) and by adjusting the back-up wheel. By properly adjusting the synchronizer, or providing the proper proportioning of parts to adjust the elliptical pattern of motion where fixed interval operation is desired, the apparatus of the present invention can be employed to accurately and clearly mark a succession of heat-sensitive articles at the same relative position.

The marking head 12 is shown in FIG. 2 to be removably positioned between heated upper marker holder 46 and heated lower marker holder 48. This makes rapid changes in marking information possible. Heaters 50 are preferably heated electrically for responsive control and rapid recovery. Thermostat 52 is provided to maintain the temperature at a level effective to mark the heat sensitive articles 42 as they are being continuously conveyed past the marking head at a desired speed, typically greater than 1500 inches per minute and preferably greater than 1800 inches per minute, although lower line speeds can also be employed. Temperatures on the order of from about 200° to about 500° C. will be required for paperboard, such as a regular density, solid bleached sulfate paperboard coated with polyethylene. Preferably, the temperature will be maintained within a 250° to 400° C. range and optimally within the range of from 300° to 350° C.

According to a preferred embodiment of the invention the drive parts will be protected from the heat to some extent by positioning heat sinks 54 and 56. These heat sinks are shown as disks fitted about bearing housing 30, and bearing 32 on shaft 28 and directly subadjacent orbiting arm 18. The combination of the bearing and the heat sink increases the life of the apparatus by decreasing wear.

FIGS. 2 and 5 show from the side and in perspective, the relationship of the various parts shown from the top in FIGS. 1 and 3, which cause the motion of marking head 12. FIG. 5 shows those parts which can be seen from the rear. Bearing housing 30 carries bearing 32 and shaft 28, which in turn is surrounded by heat sinks 54 and 56. Orbiting arm 18 has aperture 26 within which the shaft 28 and its associated bearing and bearing housing fit. Shaft 28 is shown located on eccentric arm 34, eccentrically of drive shaft 36 which supplies rotary drive motion to the drive arm 34. Rotary drive motion is transmitted to drive shaft 36 from sprocket means 44 by means of right angle gear box 62 of conventional construction. Alternatively the rotary motion can be transmitted directly.

FIGS. 1–3 and 5 show the marking head in the full-forward, marking position. As the eccentrically mounted shaft 28 is driven further in the clockwise direction, the movement of the marking head 12 in the direction of the movement of article 42 is exagerated by virtue of the marking head being positioned at the end of orbiting arm 18 as it is being pivoted by shaft 28 about pivotal connection 20. As the shaft 28 is driven clockwise, it starts the withdrawal of the marking head 12 from the marking position, but the rate of withdrawal is low relative to the length of contact in the direction of article movement. The duration of contact with the article 42 is yet further prolonged in the preferred embodiment where the marking head is caused to compress the resilient surface 38 of backup wheel 14. As the marking head 12 is withdrawn from contact with the article 42, slide 22 at the opposite end of orbiting arm 18 slides backward along movement line C in channel 24. Backward motion will continue until shaft 28 reaches the diametrically opposite position from that shown in FIGS. 1–3 and 5, at which position the marking head 12 will be at the withdrawn position. Continuous clockwise rotation of shaft 28 from the withdrawn position will cause orbiting arm 18 to bring marking head 12 through the lower half of the elliptical path shown in FIG. 1 and back into marking contact with the next successive article 42.

Electrical power for heating the marking head is shown to be supplied schematically at 64 with adjustment facilitated by thermostate 52 and on/off power switch 66 which can be calibrated to provide desired temperature settings. The detail of wiring to the heaters 50 is omitted in the sake of conciseness, as it will be understood by those skilled in the art that any suitable connection scheme can be employed. Likewise, while pneumatic control means 40 and 41 are shown generally, the detail is well known and not essential for a person of ordinary skill in the art to construct the apparatus of the invention.

The marking head will contain at least one line of at least one character and preferably be large enough to carry at least two lines of indicia with a lateral extent in the direction of article movement of at least four characters. For example, where article to be printed are conveyed at constant seven to twenty inch spacings, the apparatus of the present invention can be employed to clearly imprint two or more lines of indicia extending from about 0.1 to 1.5 inches across the articles in the direction of movement. Further, marking can be effected at linear speeds in excess of 1800 inches per minute. If desired, the marking head can contain greater than two lines of indicia with greater than four characters while still effectively marking the articles.

The above description has been for the purpose of teaching the person of ordinary skill in the art how to make and use the invention. And, while the description and drawings have disclosed in detail the best mode for carrying out the invention, other modifications and variations of it are contemplated and many will become apparent to the skilled worker upon reading the description. It is intended that all such modifications and variations of the invention be included within the scope of the invention which is defined by the following claims.

We claim:

1. A marking apparatus for marking a continuous succession of spaced-apart articles comprising heat sensitive material, said articles moving at a speed in excess of 1500 inches per minute and said marking being at least four characters in the direction of flow comprising:

an electrically-heated marking head;

backup means positioned opposite the marking head, said backup means comprising a wheel with a resilient surface;

and means for reciprocating the marking head between a withdrawn position and a marking position adjacent said backup means, including means for effecting an overall elliptical movement of the marking head, thereby permitting accurate marking and prolonged contact in the direction of flow between the articles moving continuously past the marking head and said marking head, said means including an orbiting arm, with the marking head mounted on one end thereof and with the opposite end thereof being pivotally connected to a slide adapted for reciprocal movement within a slide channel and a shaft eccentrically attached to a rotating drive means, said shaft being fitted in an aperture in said orbiting arm.

2. An improved marking apparatus according to claim 1 wherein said backup means comprises means for withdrawing said backup means from said marking position responsive to an interruption in the continuous movement of articles to be marked.

3. An improved marking apparatus according to claim 1 which further comprises means to control the temperature of the marking head to a temperature within the range of from about 200° to about 500° C.

4. An improved marking apparatus according to claim 3 wherein the marking head is controlled to a temperature within the range of from 250° to about 400° C.

* * * * *